US006820371B1

(12) United States Patent
Park

(10) Patent No.: US 6,820,371 B1
(45) Date of Patent: Nov. 23, 2004

(54) HIDDEN RAIL TYPE WINDOW AND DOOR SYSTEM

(76) Inventor: Ki-Young Park, 16-3 Gamjung-dong, Kimpo-si, Kyungki-do 415-010 (KR)

( * ) Notice: Subject to any disclaimer, the term of this patent is extended or adjusted under 35 U.S.C. 154(b) by 0 days.

(21) Appl. No.: 10/129,181

(22) PCT Filed: Nov. 2, 2000

(86) PCT No.: PCT/KR00/01251

§ 371 (c)(1),
(2), (4) Date: Jul. 12, 2002

(87) PCT Pub. No.: WO01/33024

PCT Pub. Date: May 10, 2001

(30) Foreign Application Priority Data

Nov. 3, 1999 (KR) ..... 99/23893 U

(51) Int. Cl.[7] ..... E05D 13/00
(52) U.S. Cl. ..... 49/425
(58) Field of Search ..... 49/409, 410, 408, 49/404, 425

(56) References Cited

U.S. PATENT DOCUMENTS 3,106,754 A * 10/1963 Grossman ..... 49/410
4,084,361 A 4/1978 Aspaas
4,114,331 A * 9/1978 Yamamoto ..... 49/404
4,333,283 A * 6/1982 Ebata ..... 49/504
4,413,444 A * 11/1983 Chikaraishi ..... 49/409
4,447,985 A 5/1984 Weber et al.
4,803,809 A * 2/1989 Takemura ..... 49/404

FOREIGN PATENT DOCUMENTS

GB 2 102 052 1/1983
KR 96-038040 11/1996

* cited by examiner

*Primary Examiner*—Jerry Redman
(74) *Attorney, Agent, or Firm*—Smith-Hill and Bedell

(57) ABSTRACT

The present invention relates to a rail hidden type window and door system, including a lower window (or door) frame having a rail cover attached on a main window (or door) frame, a rail hidden by the rail cover and formed on a concave portion of a window (or door) of the main window (or door) frame of an inside of an inlet, and inlet gaskets mounted on a surface member and the rail cover; and a lower window (or door) member having a lower portion enhanced by a supporting portion, an extending portion having a roller supporting member on which a roller groove is formed, and a roller device mounted in the roller groove. Accordingly, the window (or door) is not removed from the rail and is stably opened and closed, while keeping the sealing state to minimize heat loss and preventing water from infiltrating into the interior.

17 Claims, 8 Drawing Sheets

HIDDEN RAIL TYPE WINDOW AND DOOR SYSTEM

FIELD OF THE INVENTION AND PRIOR ART

In the following description (in the field of the invention, description of the prior art, problem to be solved by the present invention, description of the invention, and effect of the invention), since the door system is identical to the window system, the description of the invention of the window system will be applied to the description of the door system.

The present invention relates to a hidden rail type window and door system.

A conventional hidden rail type window and door system will be described with reference to the accompany drawings.

FIG. 1 is a front view illustrating a window and door system to which a conventional art is applied, and FIG. 2 is a sectional view taken along line A—A illustrating a structure of the window and door system.

The conventional window and door system comprises a lower window frame member 1 having rails 12 and a window frame surface member 13 arranged on an inclined line 11, the rails 12 being hidden by water-proof covers 14 coupled to the surface member 13 and provided with window member guide inlets 19; and a lower window member 2 provided with a support member 21 formed on an extending member 23 extended from a lower portion 24 of the lower window member 2, a roller 22 being disposed between the rail 12 and the support member 21 inside an inlet 19.

However, in the above described hidden rail type window and door system, although it can prevent water from infiltrating into the interior, since a seal is not provided, thermal efficiency deteriorates. In addition, since water infiltrates into the rail, the roller may be damaged by the water. Since the fixing and supporting structure of the covers 14 is weak, the covers 14 may be deformed, deteriorating the open and close operation of the window member because of the friction between the covers and the extending member 23 of the lower window member 2 or the roller. The roller supporting method for supporting the lower portion of the lower window member 2 cannot effectively support the window member.

PROBLEM TO BE SOLVED BY THE INVENTION

The present invention has been made in an effort to solve the above-described problems. It is an objective of the present invention to provided a window and door system that can prevent water from infiltrating, minimize thermal loss by maintaining a sealing state, and provide a stable open and close operation of the window member by improving the supporting and fixing structure of a cover and a window member.

To achieve the above object, the present invention provides a hidden rail type window and door system comprising:

a lower window (or door) frame having a rail cover attached on a main window (or door) frame, a rail hidden by the rail cover and formed on a concave portion of a window (or door) of the main window (or door) frame of an inside of an inlet, and inlet gaskets mounted on a surface member and the rail cover; and a lower window (or door) member having a lower portion enhanced by a supporting portion, an extending portion having a roller supporting member on which a roller groove is formed, and a roller device mounted in the roller groove.

DESCRIPTION OF THE INVENTION

The embodiment of the present invention will be described hereinafter with reference to the accompany drawings.

Figure 1:
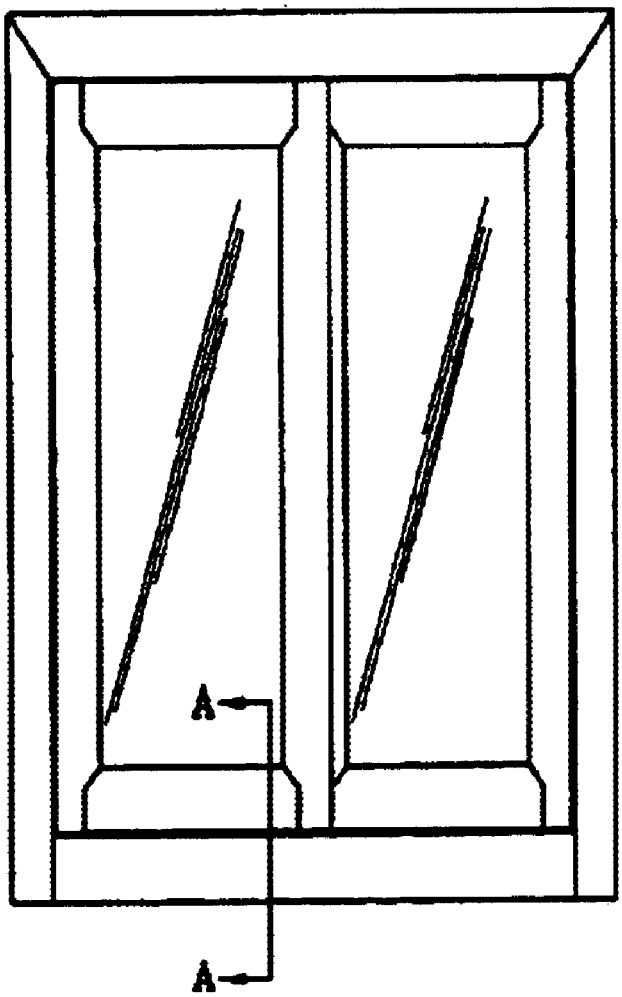
FIG. 1 (PRIOR ART)
FIG. 1 is a front view of a window and door system where a conventional technology is applied.
Figure 2:
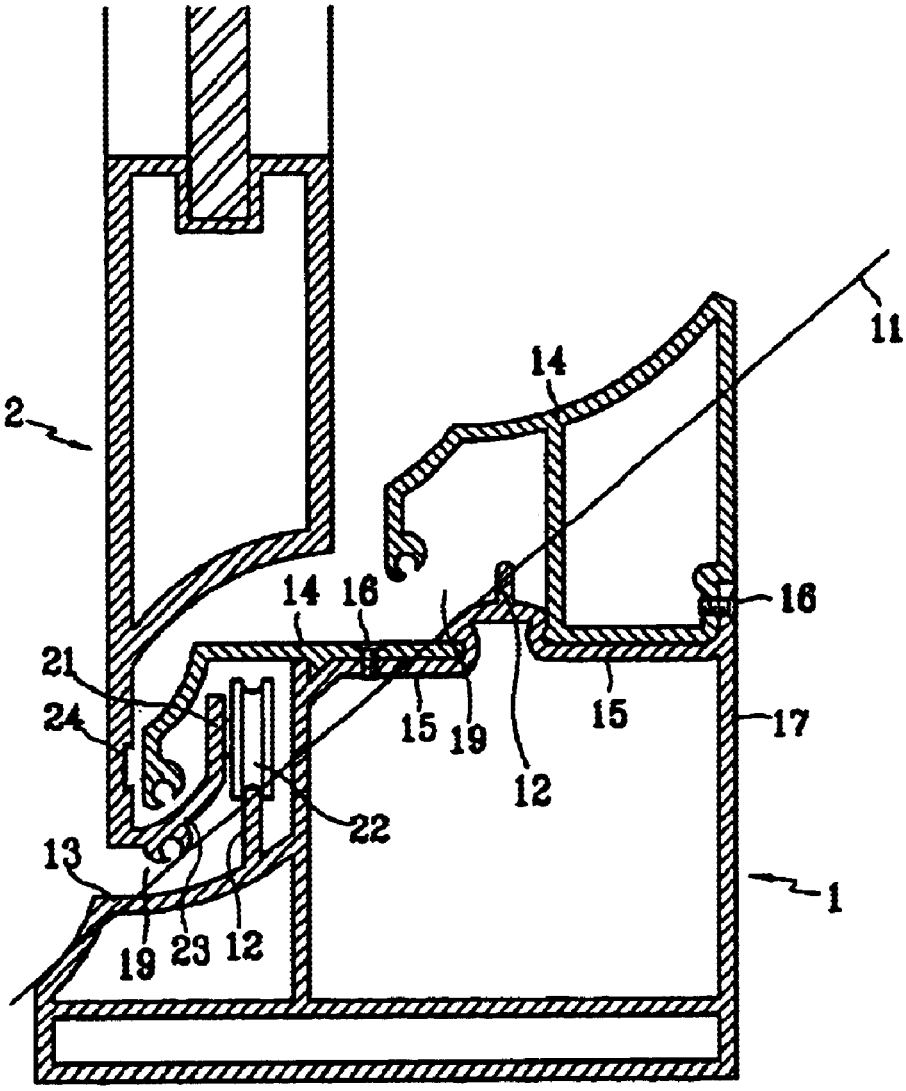
FIG. 2 (PRIOR ART)
FIG. 2 is a sectional view taken along line A—A of FIG. 1.
Figure 3:
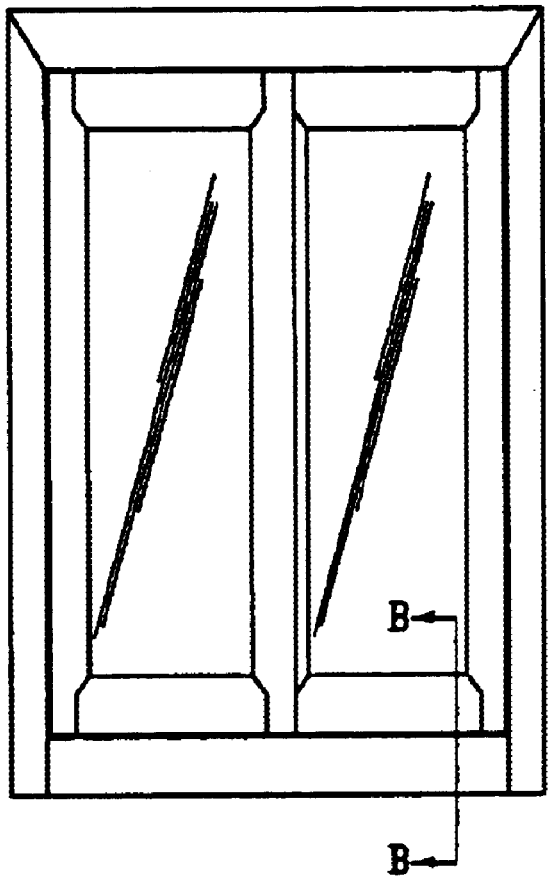
FIG. 3 is a front view of a window and door system according to the present invention.
Figure 4:
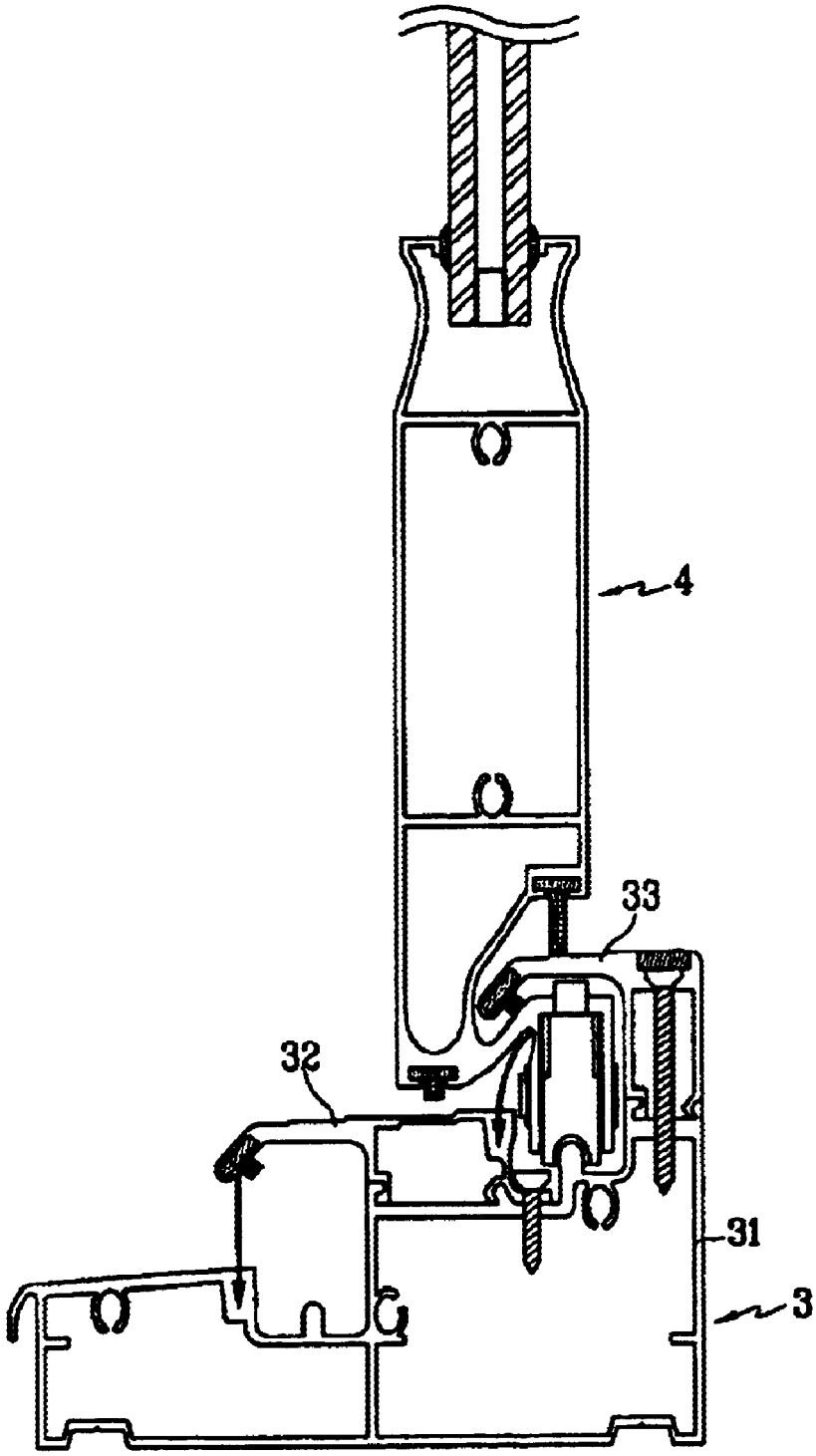
FIG. 4 is a sectional view taken along line B—B of FIG. 1.

FIG. 3 shows a front view illustrating a window and door system according to the present invention and FIG. 4 shows a sectional view taken along line B—B of FIG. 3.

Figure 5:
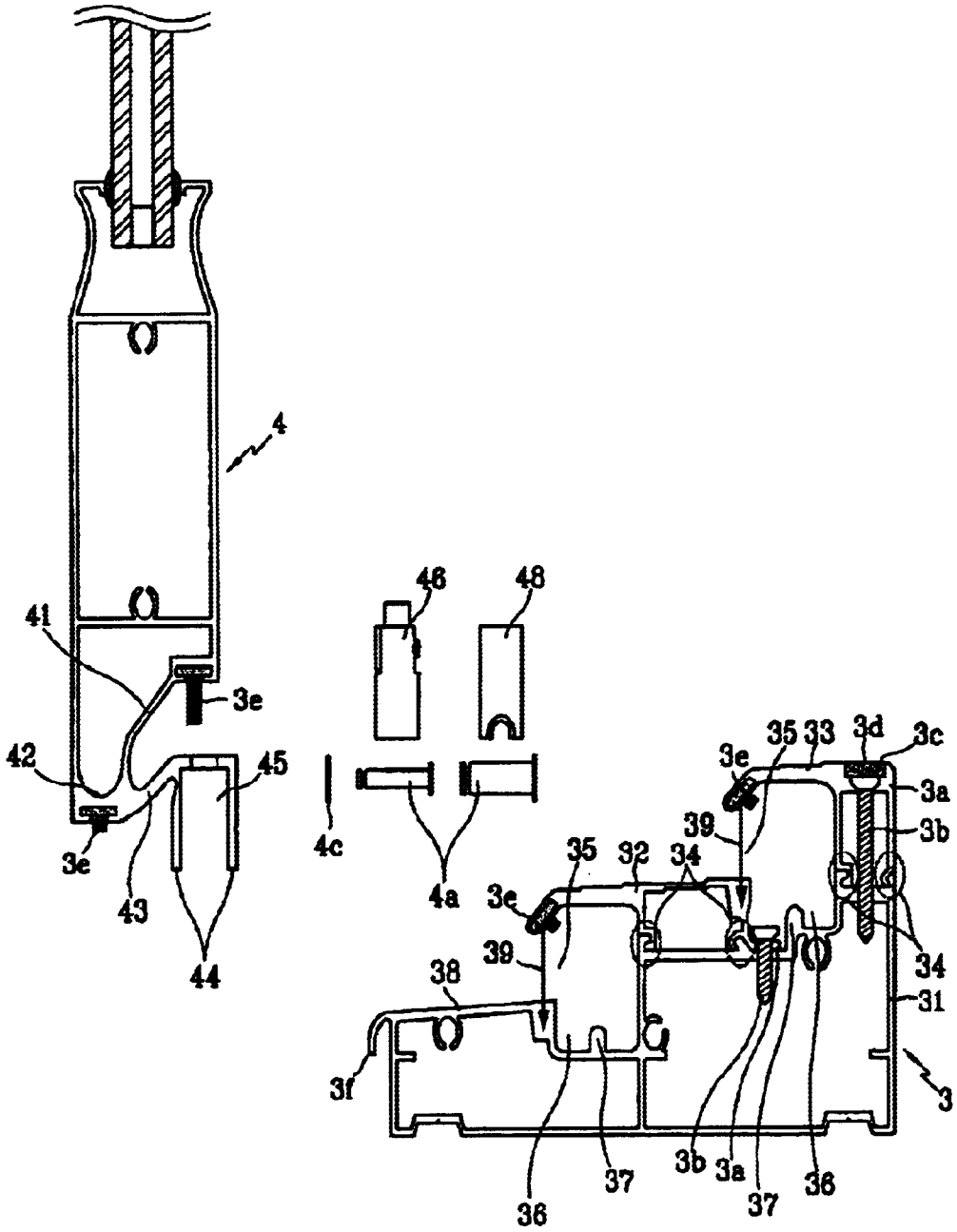
FIG. 5 is an exploded view of FIG. 4.
Figure 6:
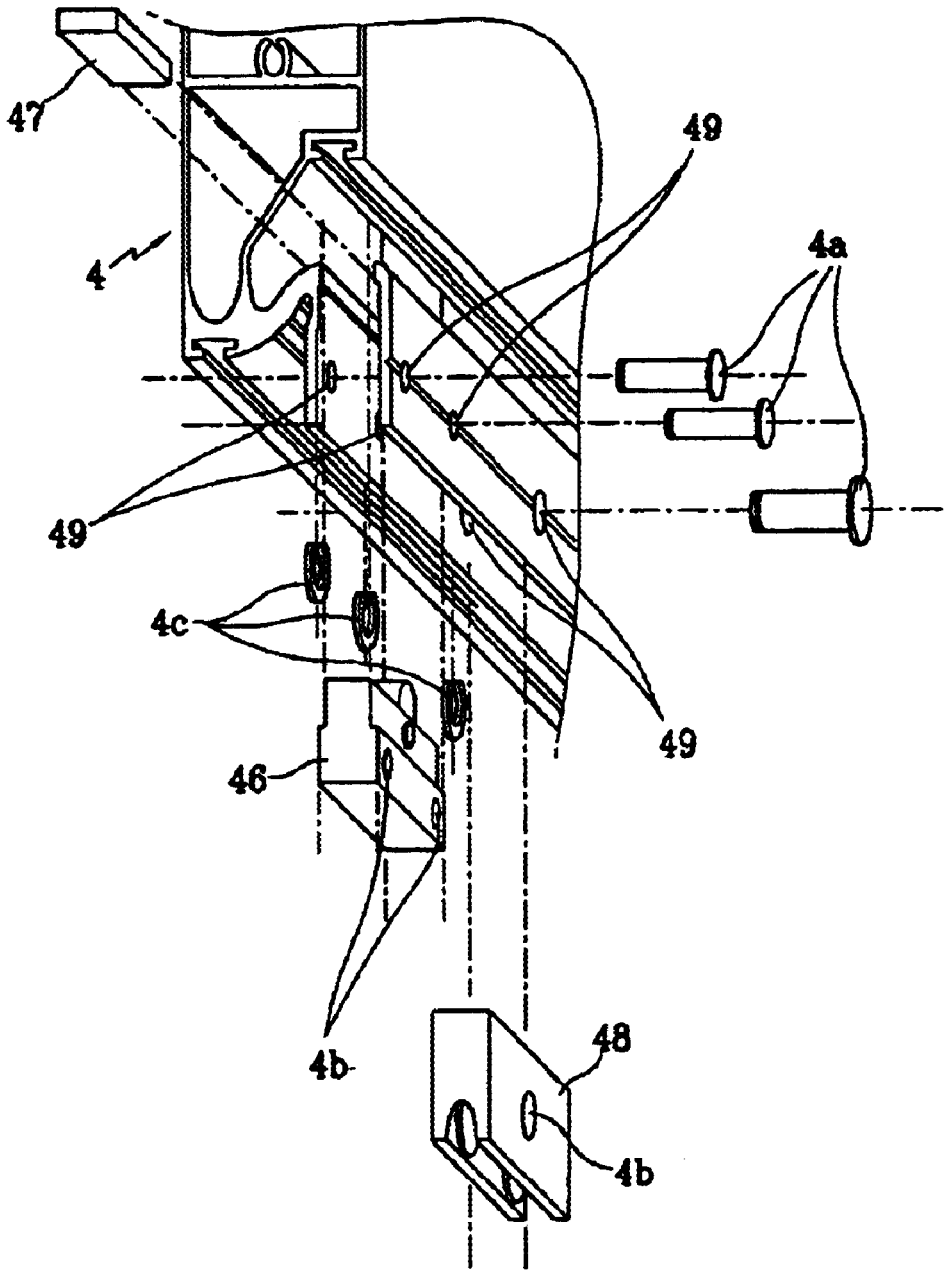
FIG. 6 is a view illustrating a cover support roller and a roller device.

FIG. 5 shows an exploded view of FIGS. 4, and 6 shows a view illustrating a cover support roller and a roller device mounted on the lower window member 4.

A lower window frame member 3 comprises a window frame main body 31 and rail cover 32.

The main window frame member 31 and the rail cover 32 are provided with fixing portions 34, respectively. Inside of inlets 35 of the main window frame member 31, concave portions 36 and rails 37 are formed. The inlets 35 are blocked by gaskets 39 mounted on a surface member 38 and the rail cover 32.

By forming a support portion 41 for supporting the window on the lower window member 4, the lower portion 42 of the window is enhanced. An extending portion 43 is formed on the lower portion 42 on which roller support members 44 are formed. A roller groove 45 is formed between the roller support members 44.

To install a cover supporting member 46, a cutting portion 47 is formed on the roller groove 45, and assembly holes 49 are formed on the roller support members 44 to correspond to the cover supporting member 46 and a roller device 48. The cover supporting member 46 is mounted on the cutting portion 47 of the roller groove 45, and the roller device 48 is inserted in the uncut portion of the roller groove 45. In this state, fixing pins 4*a* pass through the assembly holes 49 of the roller support member 44 and assembly holes 4*b* of the cover supporting member 46 and the roller device 48, and are fixed by fixing clips 4*c*.

To maintain a seal between the lower window frame member 3 and a lower window member 4, wind shield members 3*e* are mounted on the rail covers 32 and 33, the lower portion 42 and the support portion 41 of the lower window member 4.

Gaskets 39 having elasticity define an inlet 35 by being depressed by the extending portion 43 in the presence of the lower window member 4, or obstruct the inlet 35 by being returned to their initial shape in the absence of the lower window member 4. FIG. 4 shows a state where the inlet is defined by depressing the gasket 39 using the extending portion 43, and FIG. 5 shows a state where the inlet is obstructed by the returning of the gasket to its original shape.

The rail covers 32 and 33 are attached on the main window frame member 31 by the fixing portions 34. However, it can be more fixedly mounted on the main window frame member 31 by screws 3*b* coupled on screw supporting members 3*a* formed on the rail covers 32 and 33. Exposed screw groove 3*c* is finished using a screw groove plug 3*d*.

Figure 7:
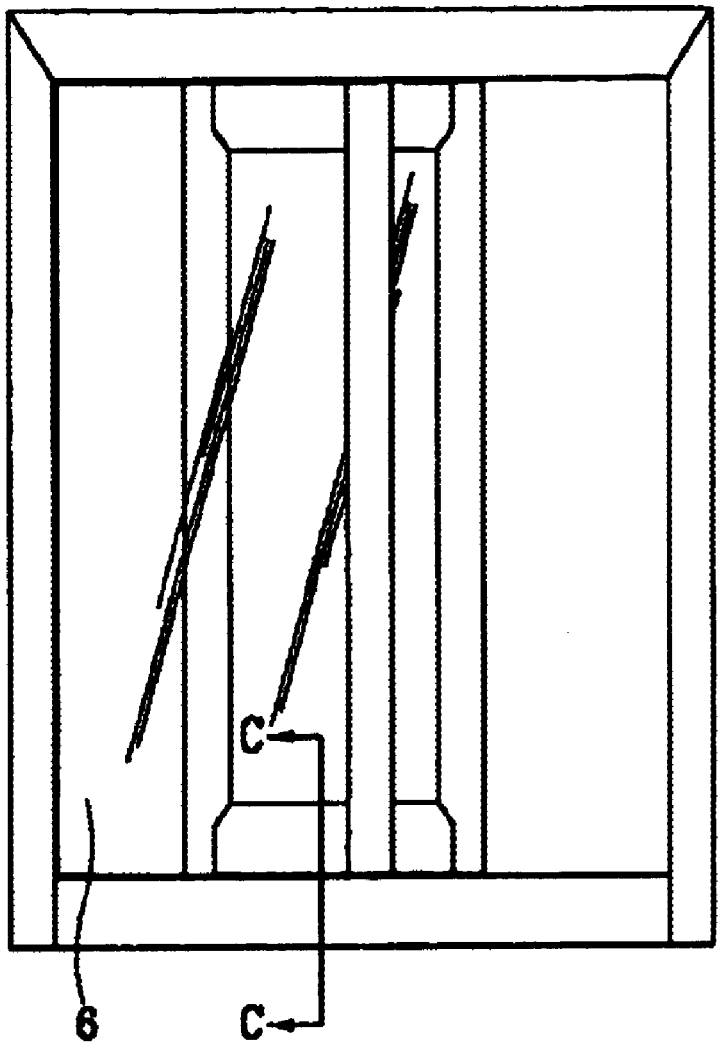
FIG. 7 is a front view of a window and door system according to the present invention where a fixed window is applied.
Figure 8:
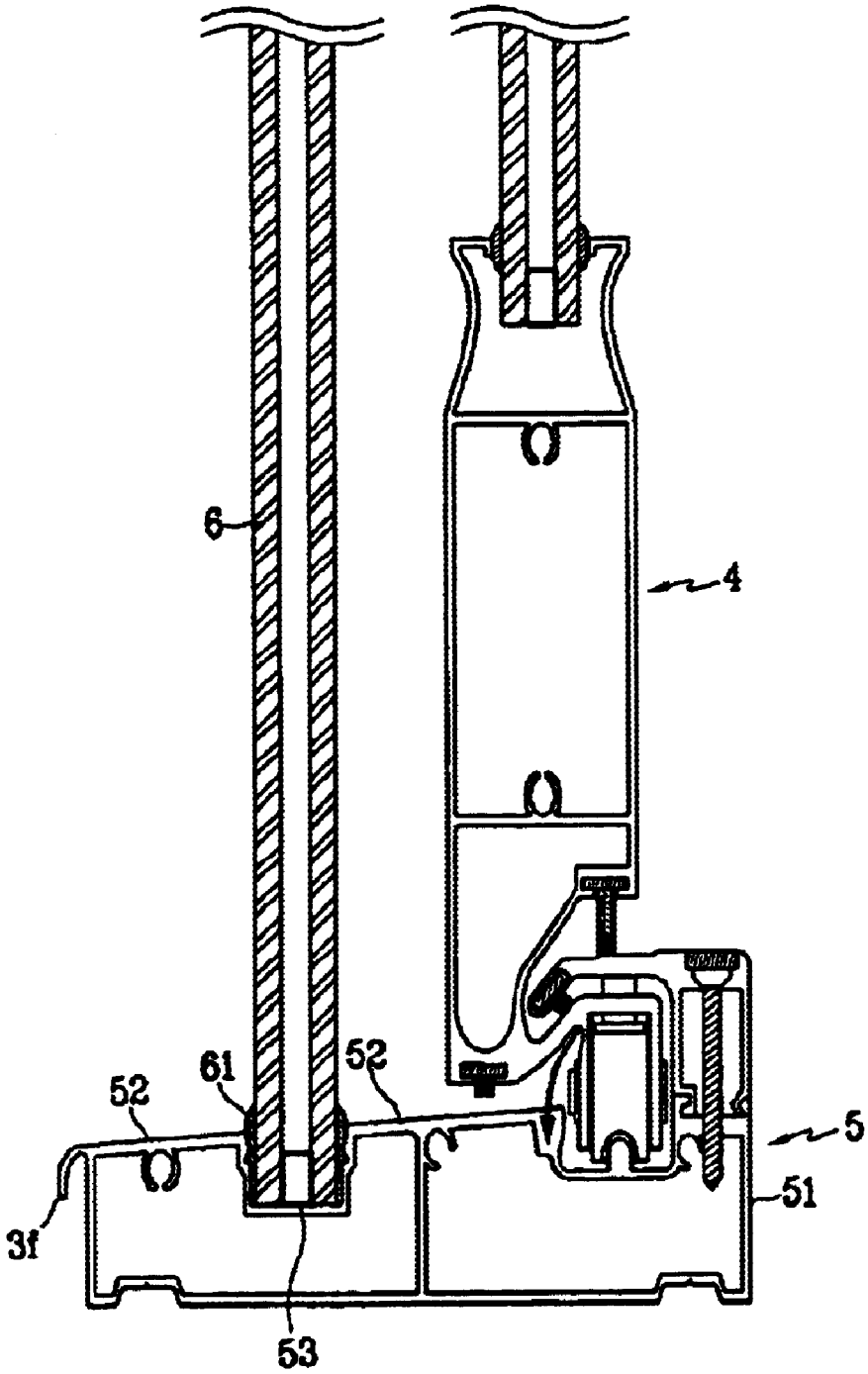
FIG. 8 is a sectional view taken along line C—C of FIG. 7.

FIG. 7 shows a front view of a window system to which a fixed window is applied, and FIG. 8 shows a sectional view taken along line C—C.

To mount the fixed window 6, a fixed window groove 53 is formed on surface members 52 of the main window frame member 51. The fixed window 6 is inserted into the fixed window groove, and is then finished by a fixing member 61.

EFFECT OF THE INVENTION

As described above in the hidden rail type window and door system, since there are fixing portions 34 on the rail cover 32 and the main window frame member 31, the separation of the rail cover 32 can be prevented when the lower window member 4 is removed. In addition, by using the screws 3*b*, the rail covers 32 and 33 can be more securely fixed on the window frame main body 31. Since the exposed screw groove 3*c* is finished by the screw groove plug 3*d*, the appearance can be more clean.

The inlets 35 can be blocked by the gaskets 39, preventing water from infiltrating to the rails 37.

Even when the rail covers 32 and 33 are deformed by impact, the window frame can be smoothly opened and closed by the cover supporting member 46, while re-covering the deformed rail covers 32 and 33.

By forming the support portion 41 on the lower window member 4, the lower portion of the window member 4 is enhanced, improving the supporting efficiency. By providing the roller support members 44 with the roller groove 45, the roller device 48 can be securely installed.

By installing the wind shield members 3*e* on the support portion 41, the lower portion 42 of the lower window member 4 and the rail covers 32 and 33, the sealing efficiency can be improved.

In addition, a mosquito net rail 3*f* can be provided on an exterior side of the surface members 38 and 52.

What is claimed is:

1. A sliding window or door system comprising:

an elongate frame lower member (3) including a surface member (38) defining an elongate channel (36) that extends lengthwise of the elongate frame lower member between first and second opposite edge regions of the surface member, a rail (37) located in the channel, a rail cover (32) attached to the frame lower member at the first edge region of the surface member and including a portion that extends laterally over the channel towards the second edge region of the surface member, a slidable leaf lower member (4) having a lower portion (42), a brace portion (41) for enhancing the lower portion, an extending portion (43) that extends laterally from the lower portion, and a roller supporting portion (44) that is attached to the extending portion and is formed with a roller groove (45), and a roller device (48) mounted in the roller groove, wherein the rail cover and the surface member define an inlet opening (35) that provides access to the channel, the lower portion of the slidable leaf lower member is positioned over the second edge region of the surface member, the roller supporting portion is positioned beneath the rail cover, and the roller device engages the rail, and the system further comprises a gasket (39) attached to the surface member at the second edge region and engaging the slidable leaf lower member.

2. A sliding window or door system according to claim 1, wherein the slidable leaf lower member has an upper portion that is spaced laterally of the lower portion, the brace portion extends between the upper portion and the lower portion, and the brace portion and the extending portion define a recess into which the rail cover extends.

3. A sliding window or door system according to claim 2, wherein the upper portion of the slidable leaf lower member is positioned over the channel.

4. A sliding window or door system according to claim 1, further comprising a wind shield member (3*e*) attached to the frame lower members and engaging the slidable leaf lower member for maintaining a seal between the slidable leaf lower member and the frame lower member.

5. A sliding window or door system according to claim 1, wherein the slidable leaf lower member has an upper portion that is spaced laterally of the lower portion, the brace portion extends between the upper portion and the lower portion, and the brace portion and the extending portion define a recess into which the rail cover extends and the system further comprises a wind shield member attached to the rail cover and engaging the extending portion for maintaining a seal between the slidable leaf lower member and the frame lower member.

6. A sliding window or door system according to claim 1, further comprising a wind shield member (3*e*) attached to the slidable leaf lower member and engaging the frame lower member for maintaining a seal between the slidable leaf lower member and the frame lower member.

7. A sliding window or door system according to claim 6, wherein the slidable leaf lower member has an upper portion that is spaced laterally of the lower portion, the brace portion extends between the upper portion and the lower portion, and the brace portion and the extending portion define a recess into which the rail cover extends, and the wind shield member is attached to the upper portion and engages the rail cover.

8. A sliding window or door system according to claim 1, wherein the rail cover and the surface member define a second elongate channel that extends lengthwise of the frame lower member and the system further comprises a second rail located in the second channel and a second rail cover attached to the surface member and extending over the second rail.

9. A sliding window or door system according to claim 1, comprising a rail cover supporting member (46) attached to the lower part of the slidable leaf lower member and positioned beneath the rail cover.

10. A sliding window or door system according to claim 9, wherein the rail cover supporting member is positioned in the roller groove and projects upward above the roller supporting member.

11. A sliding window or door system according to claim 9, wherein the rail cover supporting member in positioned in the roller groove and includes a roller that projects upward above the roller supporting member.

12. A sliding window or door system according to claim 9, wherein the rail cover supporting member and the roller supporting portion of the slidable leaf lower member are formed with assembly holes, and the system further comprises fixing pins that extend through the holes for securing the rail cover supporting member to the roller supporting portion.

13. A sliding window or door system according to claim 1, wherein the roller device and the roller supporting portion of the slidable leaf lower member are formed with assembly holes, and the system further comprises a fixing pin that extends through the holes for securing the roller device to the roller supporting portion.

14. A sliding window or door system according to claim 1, wherein the rail cover includes a screw attachment element (3*a*) and the rail cover is attached to the frame lower member by a screw (3*b*) that engages the screw attachment element.

15. A sliding window or door system according to claim 1, wherein the surface member is formed with a groove that is parallel to said channel and the system further comprises a fixed panel located in said groove and a fixing member effective between the fixed panel and the surface member.

16. A sliding window or door system according to claim 1, wherein the surface member is formed with a mosquito net rail.

17. A sliding window or door system according to claim 1, wherein the extending portion of the slidable leaf lower member extents upward from the lower portion, the roller supporting portion extents downward from the extending portion, whereby a recess is defined between extending portion and the roller supporting portion, and the gasket extends into said recess.

* * * * *